US006926457B2

(12) United States Patent
Vidal Esmoris

(10) Patent No.: US 6,926,457 B2
(45) Date of Patent: Aug. 9, 2005

(54) DEPILATORY WAX APPLICATOR

(75) Inventor: Raul Vidal Esmoris, Madrid (ES)

(73) Assignee: Phytolab, S.L., Madrid (ES)

( * ) Notice: Subject to any disclaimer, the term of this patent is extended or adjusted under 35 U.S.C. 154(b) by 0 days.

(21) Appl. No.: 10/856,411

(22) Filed: May 28, 2004

(65) Prior Publication Data

US 2004/0258459 A1 Dec. 23, 2004

Related U.S. Application Data

(63) Continuation of application No. PCT/ES01/00468, filed on Nov. 29, 2001.

(51) Int. Cl.[7] ..... B05C 17/00

(52) U.S. Cl. ..... 401/1; 401/139; 401/266; 222/566

(58) Field of Search ..... 401/1, 2, 139, 401/266; 222/566

(56) References Cited

U.S. PATENT DOCUMENTS 184,776 A * 11/1876 Grover ..... 401/266
421,362 A * 2/1890 Underwood ..... 401/264
2,945,008 A * 7/1960 Caldwell et al. ..... 528/73
2,988,775 A * 6/1961 Painter et al. ..... 401/261
4,865,034 A 9/1989 Van Der Molen
5,387,044 A * 2/1995 Accardo ..... 401/5
5,395,175 A 3/1995 Bontoux et al.
5,727,893 A * 3/1998 Handler ..... 401/264
5,873,666 A 2/1999 Bourke et al.
5,902,060 A 5/1999 Rodriguez

* cited by examiner

*Primary Examiner*—Justine R. Yu
*Assistant Examiner*—Huyen Le
(74) *Attorney, Agent, or Firm*—Katten Muchin Rosenman

(57) ABSTRACT

An applicator including a wax container reservoir, acting at the same time as a handle, at the mouth of which there is a head attached which, acting as the applicator means proper, centers its features around the fact that, after a sector for attachment to the container reservoir neck, said applicator incorporates a gradually but noticeably narrowing area in order to achieve a parallel restriction of the flow of wax to the outlet end, where an inner rib is established that in turn produces a second pronounced narrowing, defining a slotted hole, which generates a laminar flow for the wax towards an externally concave arched vane which facilitates the application of the wax onto the user's body, said arched vane being encompassed by two triangular side partition walls that also act as lateral constraints for the wax during its application.

1 Claim, 3 Drawing Sheets

DEPILATORY WAX APPLICATOR

CROSS-REFERENCE TO RELATED APPLICATION

This is a continuation of International Application PCT/ES01/00468 filed Nov. 29, 2001.

FIELD OF THE INVENTION

The present invention refers to a depilatory wax applicator, of the type incorporating a wax container reservoir and an applicator head proper, attachable in a fixed position to said reservoir, an applicator designed in turn to be the ancillary element of a depilating appliance equipped with heating means that enable the wax to be kept molten inside the applicator reservoir. The object of the invention is mainly focused on the applicator head in order to ensure that the wax is applied in optimum conditions.

DESCRIPTION OF THE PRIOR ART

There are numerous depilating appliances in existence based on the application of wax in hot molten state, which is applied to the area of the user we want to depilate. Amongst these appliances we may mention the one described in European Patent 0273495, which includes an external housing provided at one of its tapered ends with an opening extending over its whole width determining the means of issuance of the wax contained in its interior. On the inside this housing holds a reservoir containing the wax, which is warmed by heater elements located inside the housing, while the appliance is fitted with an actuating button which, when depressed, brings about the deformation of the wax container reservoir and the resultant issuance of the wax by way of the passage provided at the front end of the housing. Consequently, in the European patent separate means are provided for heating and dispensing the wax, with the result that the appliance is a high cost unit and the wax container is not intended to be replaceable.

Other similarly well-known depilating appliances are those that use replaceable wax applicators, so that these applicators, containing their respective doses of wax, may be placed adjacent to the heater element in order that the wax may reach the suitable melting temperature and be separated from it when they are about to be used. Although these wax applicators, generally composed of a container reservoir to which an applicator head may be attached, resolve the problem of the afore-mentioned European patent 0273945, they produce a performance that leaves a lot to be desired as regards the application of the wax on the user's body, since there is considerable difficulty in controlling the flow and securing that an even layer of wax is applied.

SUMMARY OF THE INVENTION

The depilatory wax applicator proposed by the invention, belonging to the second type of those mentioned above, provides a fully satisfactory answer to the problems described above, permitting a constant delivery rate and a laminar flow of wax, with excellent results. Accordingly, more specifically and starting from a basic layout embodied in a wax container reservoir and a wax applicator head, with any configuration suitable for an appropriate manual grip during wax application, the container deposit exhibits a cylindrical neck by way of which its receives the applicator head by means of threading. This head has a series of specific features that are mainly focused on the following aspects:

After the cylindrical area of attachment of the head to the applicator, this head has a noticeably narrowing area with a tendency towards a rectangular trunco-pyramidal configuration in order to achieve a gradual parallel narrowing in its cross section, which considerably reduces the flow that may pass through it compared with the diameter of the container reservoir.

Immediately after this narrowing area, on one of the side walls, affecting both the former and a substantial part of the walls encompassing it, an inner rib is established defining a markedly narrow outlet area for the wax in the form of a slot, which determines a laminar flow for the wax.

Immediately after this restricting rib, the wall of the head opposite to one from which this rib emerges is extended in an externally concave arched vane which facilitates the application of the wax onto the user's body.

This arched vane is encompassed laterally by two triangular partitions extending to the necking rib, which prevent the wax from escaping at the sides and which restrict the width of the band of wax to be applied to the user's body.

BRIEF DESCRIPTION OF THE DRAWINGS

To supplement the description being given and in order to facilitate a clearer understanding of the features of the invention, in accordance with a preferential example of a practical embodiment of same, a set of drawings is attached as an integral part hereof, wherein, for illustrative but non-restrictive purposes, the following has been represented.

PREFERRED EMBODIMENT OF THE INVENTION

Figure 3:
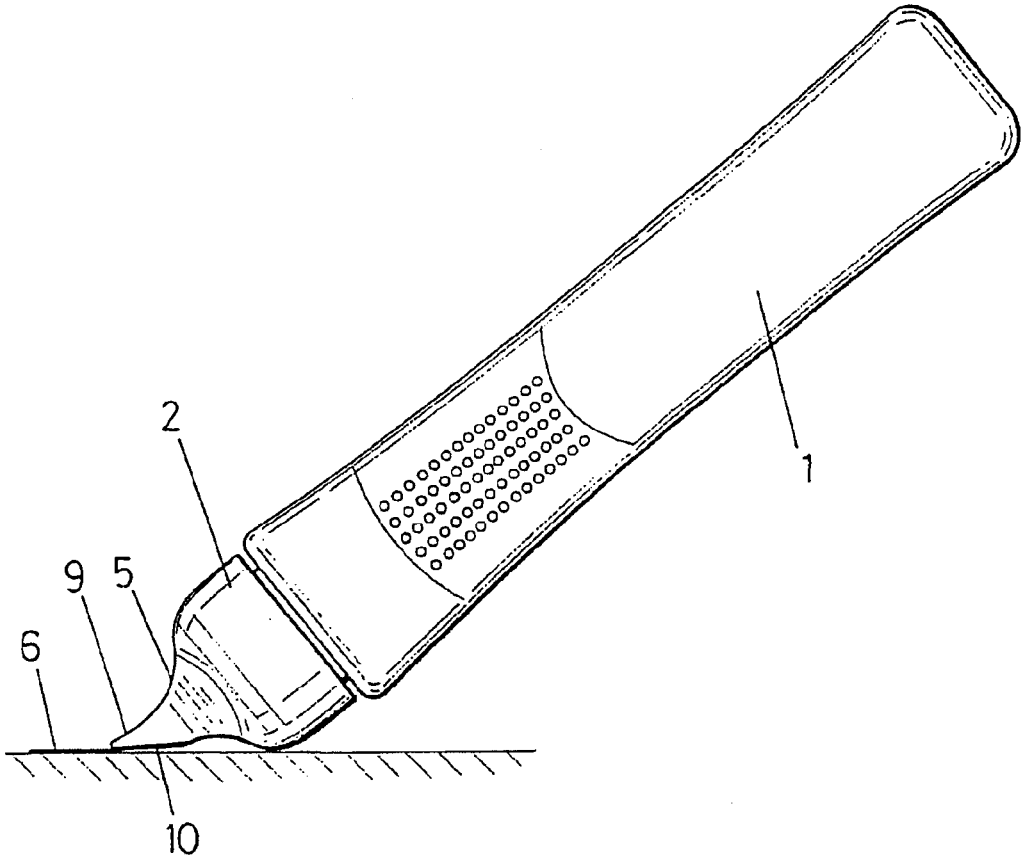
FIG. 3. Lastly, according to the schematic representation, also side elevational, it shows an example of practical use of same.

In view of the figures shown, it may be observed that the depilatory wax applicator proposed by the invention is composed, as is conventional, of the combination of a container reservoir (1) and an applicator head proper (2), while the container body (1) may adopt a layout tending towards the rectangular prism shown in the figures or any other which, with an appropriate capacity, may permit the applicator unit to be gripped easily by hand, as shown in FIG. 3, a reservoir (1) which in any case will be terminated at its open end in a threaded cylindrical neck (3) for coupling to a similarly cylindrical threaded sector of the head(3), which corresponds to the actual reference (2).

In the head (2) and after this sector of attachment to the container reservoir (1) a flow restricting area is established in which, without interruption and with a configuration tending towards the rectangular trunco-pyramidal configuration, the large circular section of the coupling sector (2) is converted into a noticeably rectangular and considerably smaller section established at terminal level (5) of this area, where, matching one of its larger edges, the one that has to be closest to the user's body (6) in the wax application operation, a transverse rib (7) is established determining a second necking area, considerably more accentuated, a rib which extends between the two side walls of the head encompassing the one from which the actual rib emerges, defines a low slotted hole (8), determining a laminar flow for the wax passing through the head.

Figure 1:
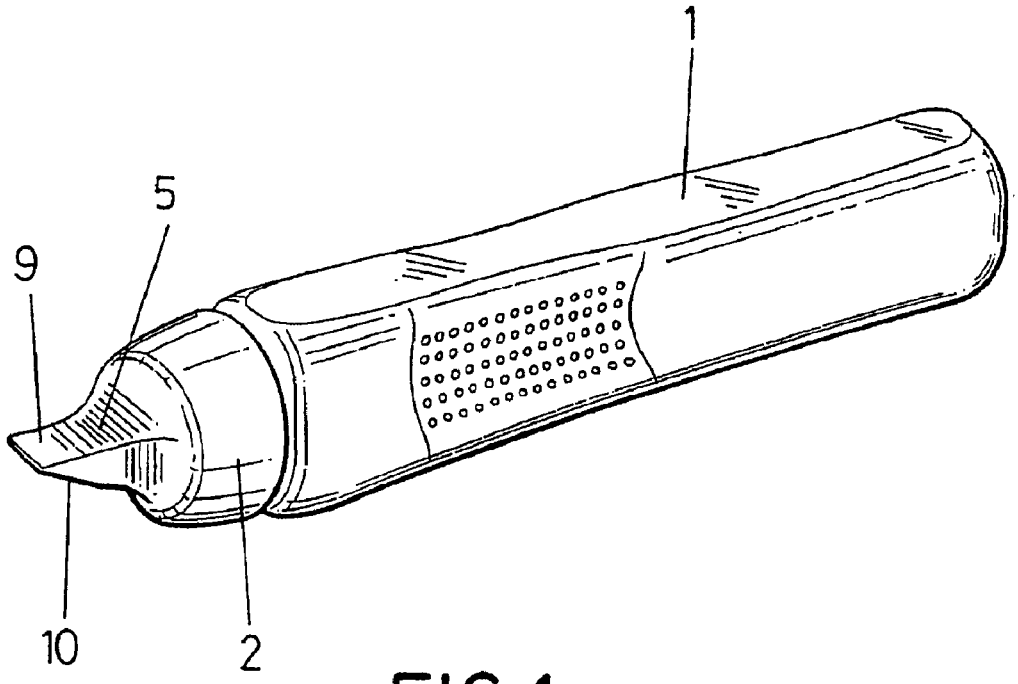
FIG. 1. It shows, according to a general perspective view, a depilatory wax applicator produced in accordance with the object of the present invention.
Figure 2:
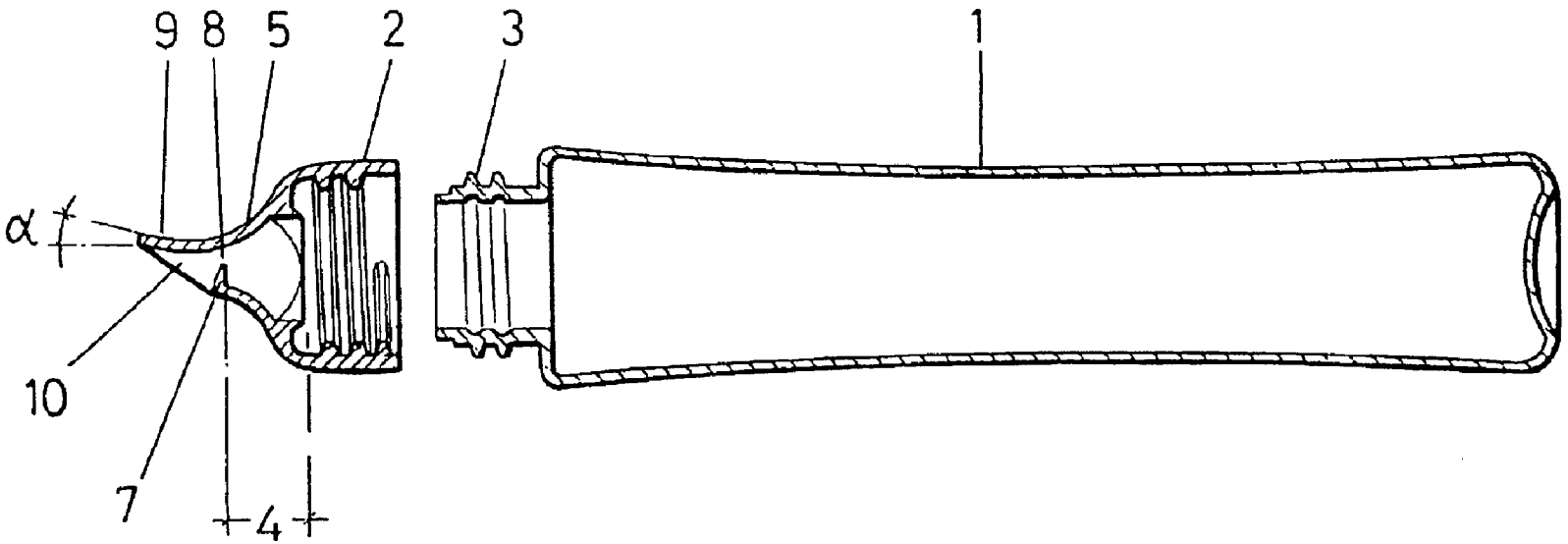
FIG. 2. It shows a side elevational, longitudinal sectional and exploded view of the same applicator.

From the rib (7) the head (2) is open on its under side, while on its upper side it determines an externally concave arched vane (9), clearly visible in FIG. 2, which facilitates the application of the wax onto the user's body (6), as is observed in FIG. 3. This arched vane (9) is encompassed at the sides by two partition walls (10) of triangular configuration, which extend to the rib (7), i.e. to the more restrictive end (5) of the intermediate area (4), said partitions (10) acting as means of lateral contention for the wax, which prevent it from issuing from these unwanted areas, so that as a result the use of the applicator ensures that a strip of applied wax is obtained of perfectly constant specified width, while at the same time preventing the formation of accidental lateral discharges at this strip which could become detached from it at the depilation stage, i.e. in the phase of separation of the strip of wax from the user's body, giving rise to residues on the user's skin which would call for a subsequent uncomfortable cleaning process.

I claim:

1. A depilatory wax applicator comprising:

a wax container reservoir intended to be associated temporarily with a heater element in order to keep the wax liquid, said container reservoir ending in a threaded cylindrical neck and an applicator head having a mouth and fitted with an inner rib emerging from one of the edges of the mouth which, with the opposite edge of the mouth, define a transversally slotted hole, said applicator head further comprising a threaded sector for coupling to the threaded cylindrical neck, a flow restricting area having a rectangular trunco-pyramidal configuration and a large arched vane opposite the inner rib with an outward facing concavity which facilitates the application of the wax onto a user's body, said arched vane having an end with side edges and being encompassed by two triangular side partition walls that extend from the side edges of the end of the arched vane to the inner rib and which act as means of lateral contention for the wax, determining the formation therewith of a strip of applied wax of a constant width.

* * * * *